United States Patent [19]

Tai

[11] Patent Number: 5,022,152

[45] Date of Patent: Jun. 11, 1991

[54] METHOD FOR MAKING IMPROVED SUPPORT ARMS FOR GOLF SWING TRAINING AIDS

[76] Inventor: William K. Tai, E. 14725 Terra Verde Ct., Veradale, Wash. 99037

[21] Appl. No.: 546,588

[22] Filed: Jun. 29, 1990

Related U.S. Application Data

[62] Division of Ser. No. 458,780, Dec. 29, 1989, Pat. No. 4,955,612.

[51] Int. Cl.[5] ..... B29G 45/14

[52] U.S. Cl. ..... 29/897; 29/527.1; 29/530; 264/138; 264/278; 425/129.1

[58] Field of Search ..... 264/275, 273, 274, 279.1, 264/228, 229, 138, 278; 425/129.1; 249/93, 94, 95; 29/897, 527.1, 530

[56] References Cited

U.S. PATENT DOCUMENTS

| | | | |
|---|---|---|---|
| 1,091,985 | 3/1914 | Thompson et al. . | |
| 1,690,158 | 11/1928 | Currie . | |
| 1,976,405 | 10/1934 | LeWitt | 273/35 |
| 2,017,661 | 10/1935 | Johanson | 273/35 |
| 2,641,932 | 6/1953 | Van Kinkle | 73/379 |
| 3,111,965 | 11/1963 | Hodge | 264/228 X |
| 3,143,351 | 8/1964 | Bertrand | 273/200 |
| 3,453,889 | 7/1969 | Anello . | |
| 3,643,961 | 2/1972 | Schroeder | 273/197 R |
| 3,731,926 | 5/1973 | Vincent | 273/26 E |
| 3,815,922 | 6/1974 | Brainard | 273/184 B |
| 3,970,733 | 7/1976 | Kraft et al. | 264/273 X |
| 4,023,809 | 5/1977 | Newton | 273/184 B |
| 4,407,503 | 10/1983 | Nishizawa | 273/197 R |
| 4,633,568 | 1/1987 | Marchesi et al. | 264/228 X |
| 4,741,536 | 5/1988 | Tai et al. | 273/200 B |
| 4,852,883 | 8/1989 | Heselton et al. | 273/197 R |
| 4,927,154 | 5/1990 | Boyer et al. | 273/200 R |

*Primary Examiner*—Jan H. Silbaugh
*Assistant Examiner*—Merrick Dixon
*Attorney, Agent, or Firm*—Wells, St. John & Roberts

[57] ABSTRACT

A golf-swing practicing apparatus having an improved reinforced support arm, and method of manufacturing such an arm. The arm is molded from a plastic material and has a central reinforcing rod extending along a substantial length thereof. The rod preferably extends to be flush with one end of the arm to maximize the reinforcing effect along the length of the arm, and to facilitate manufacture of the arm. A hollow tube is preferably included at one end of the arm, and engages the reinforcing rod. A shaft is received through the hollow tube for mounting the arm relative to a support base.

1 Claim, 4 Drawing Sheets

METHOD FOR MAKING IMPROVED SUPPORT ARMS FOR GOLF SWING TRAINING AIDS

This application is a divisional application of Ser. No. 07/458,780, filed Dec. 29, 1989, now U.S. Pat. No. 4,955,612.

TECHNICAL FIELD

This invention relates generally to golf-swing practicing devices having a hitting or support arm with a golf-ball size object supported at one end, the support arm being rotatably mounted relative to a supporting base.

BACKGROUND OF THE INVENTION

This invention is an improvement upon the practicing device illustrated in my U.S. Pat. No. 4,741,536, and is applicable to other golf-swing practicing devices as well. My 4,741,536 U.S. patent is hereby incorporated by reference.

A number of golf-swing practicing devices have been developed. Such devices commonly include some mehanism whereby a ball, after being struck, travels in a circular or spiraling path about an upright pole or post. These devices enable golfers to practice their game indoors or in the confines of, for example, a backyard. Many of such devices are comprised of a rigid support arm which is mounted to rotate about a generally upright base comprised of a post. Devices such as these are disclosed, for example, in U.S. Pat. Nos. 1,091,985 to Thompson et al.; 3,643,961 to Schroeder; 2,641,932 to Van Kinkle; 1,690,158 to Currie; 4,407,503 to Nishizawa; 2,017,661 to Johanson; 4,023,809 to Newton; and my U.S. Pat. No. 4,741,536.

A goal in manufacturing any of such devices is to provide a sturdy, long-life hitting or support arm that also safely secures a golf-ball sized object at its outer hitting end. Securing of a golf-ball sized object to such arms has been conducted by both attaching a separate golf ball or golf-ball like object at the end of an arm, and also by integrally forming the ball at the end of the arm in conjunction with the formation of the arm itself. In either event, the goal is to prevent any tendency of the golf-ball sized object to be separated from the remainder of the arm primarily for safety reasons, and also to provide a sturdy product than can take repeated hard hits to provide a suitably long life to satisfy the user of the product.

BRIEF DESCRIPTION OF THE DRAWINGS

The preferred embodiment of the invention is illustrated in the accompanying drawings, in which:

FIG. 6 is an enlarged top view of the support arm of the FIG. 1 apparatus.

FIG. 9 is a diagrammatic sectional-like view of a molding apparatus for forming the support arm of FIG. 6.

DETAILED DESCRIPTION OF THE PREFERRED EMBODIMENTS

The following disclosure of the invention is submitted in furtherance with the constitutional purpose of the Patent Laws "to promote the progress of science and useful arts" (Article 1, Section 8).

Figure 1:
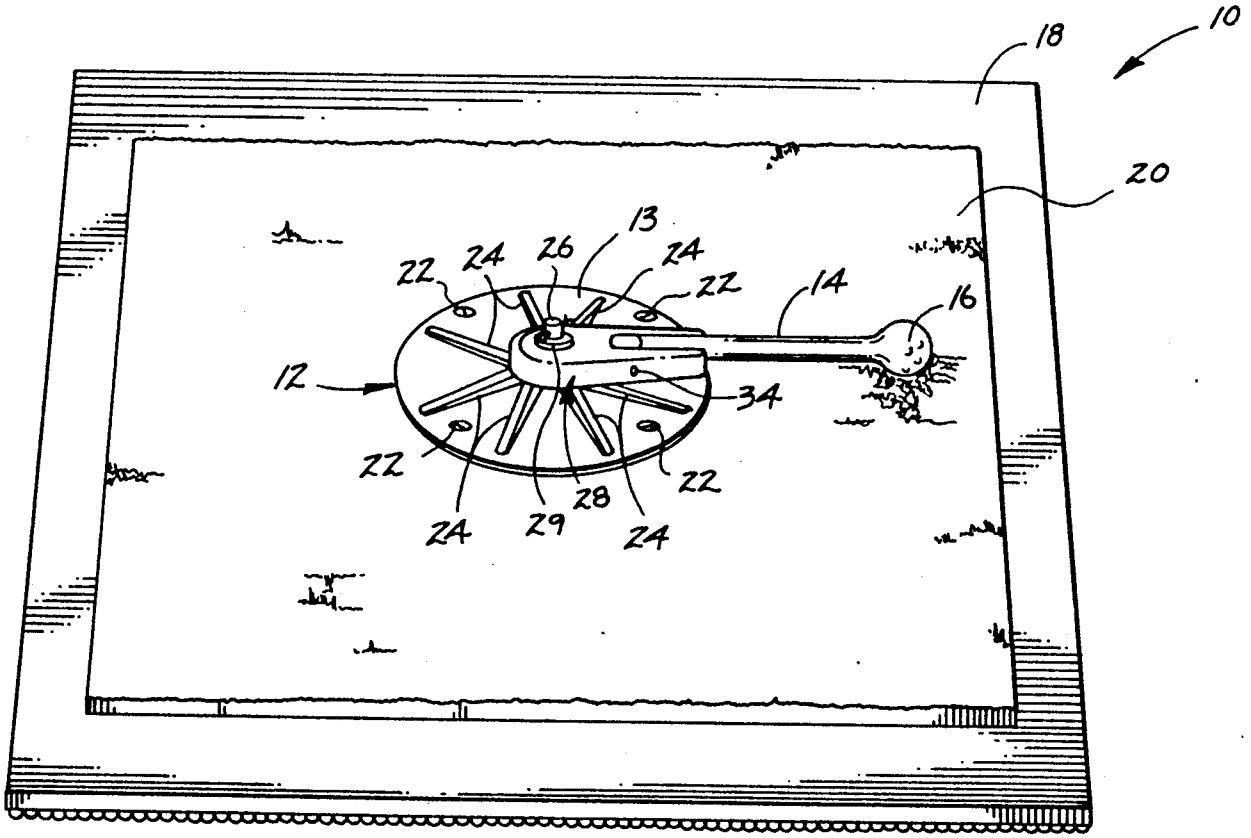
FIG. 1 is a perspective view of a golf-swing practicing apparatus in accordance with the invention.

Referring first to FIG. 1, a golf-swing practicing apparatus in accordance with the invention is indicated generally by reference numeral 10. Apparatus 10 includes a support base 12 having a hitting or support arm 14 which is rotatably mounted thereto. A golf-ball size object 16 is supported at the outer end of support arm 14. Golf-ball size object 16, upon being struck with a golf club, will revolve relative to base 12 which enable golfers to practice their swings when confined to a limited practice area. Means are provided to enable the golf-ball size object to travel in an ascending flight path due to vertical forces imparted to the golf-ball sized object when struck by the golfer. In the illustrated embodiment, this means is essentially identical in function to that disclosed in my U.S. Pat. No. 4,741,536.

More particularly, base 12 is centrally mounted to a rectangular hitting mat 18 having a smaller rectangular piece of artificial turf 20 adhered thereto. Support base 12 is circular having a planar disk-like portion 13 and a vertically oriented metal post or shaft 26 which rises elevationally therefrom. Disk portion 13 is secured through mat 18 and turf 20 by a series of nut-and-bolt combinations 22. Disk portion 13 is preferably comprised of rigid plastic (i.e. Dupont Selar Grade PT5270), and has a series of elevationally rising reinforcing gussets 24 which project radially from the center of disk 13. Post 26 is preferably molded into position at the time of molding or otherwise forming disk portion 13 to form base 12.

Figure 2:
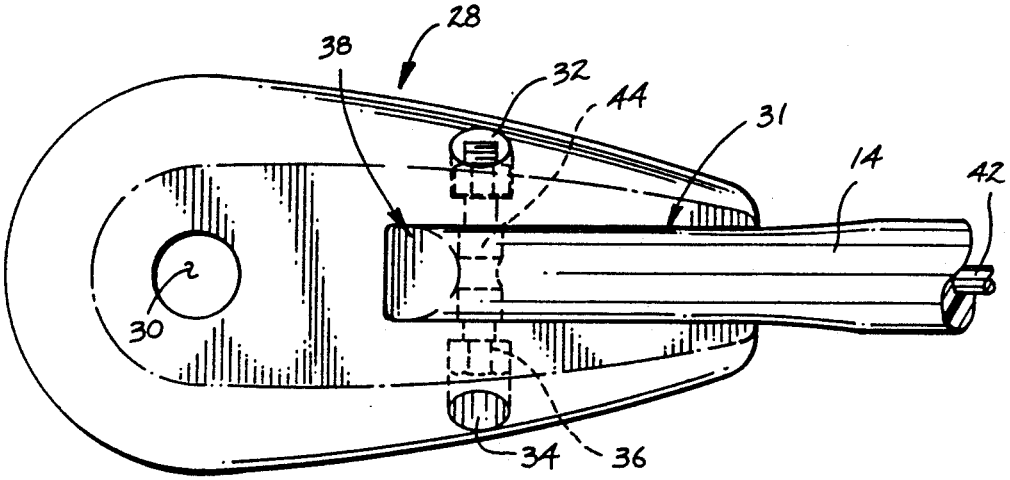
FIG. 2 is an enlarged top view of a central spinner portion of the apparatus of FIG. 1.
Figure 3:
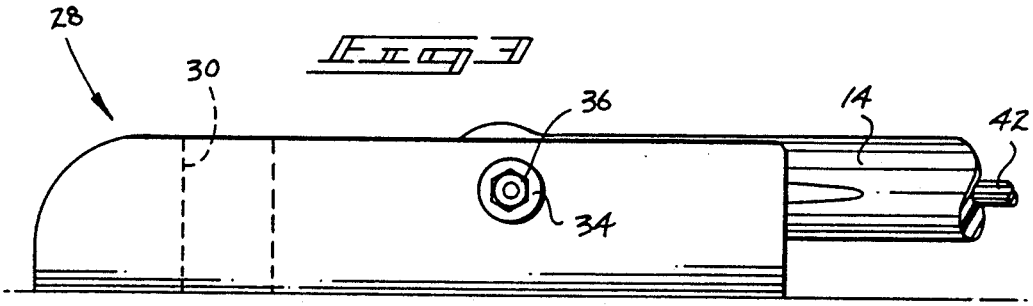
FIG. 3 is a side elevational view of FIG. 2.
Figure 4:
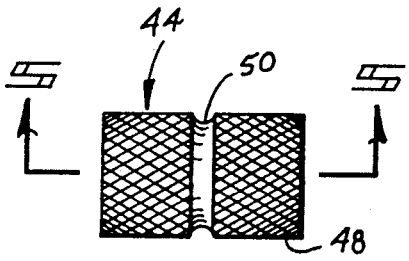
FIG. 4 is a side elevational view of an internal hollow tubular component of the apparatus of FIG. 1.

Referring more particularly now to FIGS. 1–3, a spinner or spinner block 28 is rotationally mounted relative to post 26 for both clockwise and counterclockwise rotation. In this manner, spinner block 28 is also rotationally mounted relative to base disk 13. Spinner 28 is preferably rigid, being formed of a sturdy plastic or metal material. The preferred embodiment would be made from the same plastic material from which base plate 13 is made. Spinner block 28 is preferably hollowed from its underside, and has radially or cross extending reinforcing gussets or ribs for added strength (not shown). This functions to minimize the mass of spinner 28. Alternately, spinner 28 could be constructed to be a solid mass throughout.

Spinner 28 includes a hole 30 at its inner radial end which extends vertically therethrough, as in my U.S. Pat. No. 4,741,536 spinner, for slidably receiving post 26. Post 26 includes a diametric hole at its upper end which receives a cotter pin or E-ring clip for rotationally retaining spinner 28 relative to post 26. A washer 29 is received about post 26 and is interposed between the cotter pin or E-ring clip and the spinner block 28.

A singular 'U' cross-sectioned channel 31 is likewise formed in and through the upper surface of spinner 28 at its outer radial end. A pair of counter-sunk aligned holes or bores 32, 34 extend laterally through the sides of spinner block 28 and extend to channel 31. An elongated Allan bolt-and-nut combination 36 is received by bores 32, 34, and mounts hitting arm 14 within 'U' channel 31 in a manner similar to that described in my U.S. Pat. No. 4,741,536, and as will be more fully described below. Nut-and-bolt combination 36 in the context of this invention functions as a shaft which mounts support arm 14 relative to support base 12.

Referring now to FIGS. 2-8, rigid radial support arm 14 is elongated having opposed longitudinal ends 38, 40 and respective longitudinal end surfaces 39, 41. Arm 14 is injection molded, as will be more fully described below, preferably with Surlyn TM which is a common material from which golf-ball covers are made. Support arm end 38 pivotally mounts to spinner 28. Support arm end 40 is defined by golf-ball sized object 16 which is integrally formed by the injection molding to provide the simulation of a golf ball for striking by the user of the apparatus. Dimples are preferably formed in golf-ball size object 16 by the injection mold to provide a simulation of a regulation golf ball.

Support arm 14 includes a central rigid reinforcing rod 42 which extends in a defined longitudinal direction along the substantial length of arm 14. A hollow tube 44 extends transversely through and across support arm 14 adjacent its other longitudinal end 38. The bolt of nut-and-bolt combination 36 slidably extends through hollow tube 44 making arm 14 pivotal relative to the bolt. Reinforcing rod 42 engages hollow tube 44 within the solid mass support arm to restrict any tendency of central reinforcing rod 42 to move longitudinally relative to tube 44. This functions to increase the overall strength and integrity of hitting arm 14 which will typically be subjected to a large amount of punishment upon repeated hits with a golf club.

More particularly, rod 42 has opposed longitudinal ends 43 and 45 (FIG. 8), and is preferably comprised of a tempered oil drawn chrome silica spring steel wire. Rod end 45 projects or extends longitudinally into solid mass golf-ball sized object 16 and to arm end 40 to be flush with the external longitudinal end surface 41. In the preferred embodiment, the portion within golf-ball sized object 16 includes a section which is bent to extend transversely away from the normal longitudinal orientation of rod 42. In the illustrated embodiment, rod 42 is bent to form two circular loops 47, with rod 42 then again extending in the longitudinal direction to be flush with end surface 41. It is preferable that rod 42 extend to be flush with surface 41 to maximize the strength reinforcing effect of rod 42 along substantially the entire length of arm 14. Bending of rod 42 away from the longitudinal direction further adds integrity to the arm by lessening any tendency of golf ball size object 16 to be separated from the remainder of arm 14. This facilitates bonding or knitting of the molding material with the reinforcing rod.

The other end 43 of rod 42 includes a loop 49 which engages hollow tube 44 by looping therearound, and thereafter rod 42 is looped upon itself as shown to provide a longitudinally interlocking fit of tube 44 relative to rod 42. Hollow tube 44 (FIGS. 4 and 5) is preferably comprised of metal, having an internal surface 46 and an external surface 48. External surface 48 is knurled to promote adherence of hollow tube 44 with the material from which rigid support arm 14 is injection molded. A circumferential groove 50 is centrally formed in external surface 48. This groove 50 receives and seats loop 49 of central reinforcing rod 42 to restrict transverse movement of rod 42 during the injection and hardening of the molding material at the time of formation.

Longitudinal end 38 of support arm 14 includes an angled or beveled portion 52. The base of channel 31 would be appropriately recessed for surface 52 to bear thereagainst to provide a limiting means for upward pivotal movement of arm 14, as is more fully described in my U.S. Pat. No. 4,741,536.

FIG. 9 illustrates a mold and provides for an improved method of injection molding support or hitting arms for a golf-swing practicing apparatus in accordance with the invention. Mold 54 is constructed in two upper and lower longitudinal halves 56, 58 which when combined as shown provide an elongated internal cavity 60 of a shape which corresponds to the finished external shape of finished rigid support arm 14.

Figure 5:
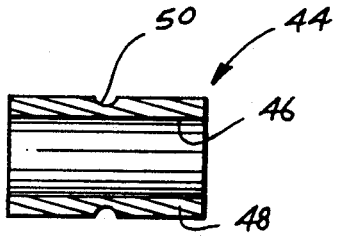
FIG. 5 is a cross sectional view taken along line 5—5 in FIG. 4.
Figures 5, 7, 8:
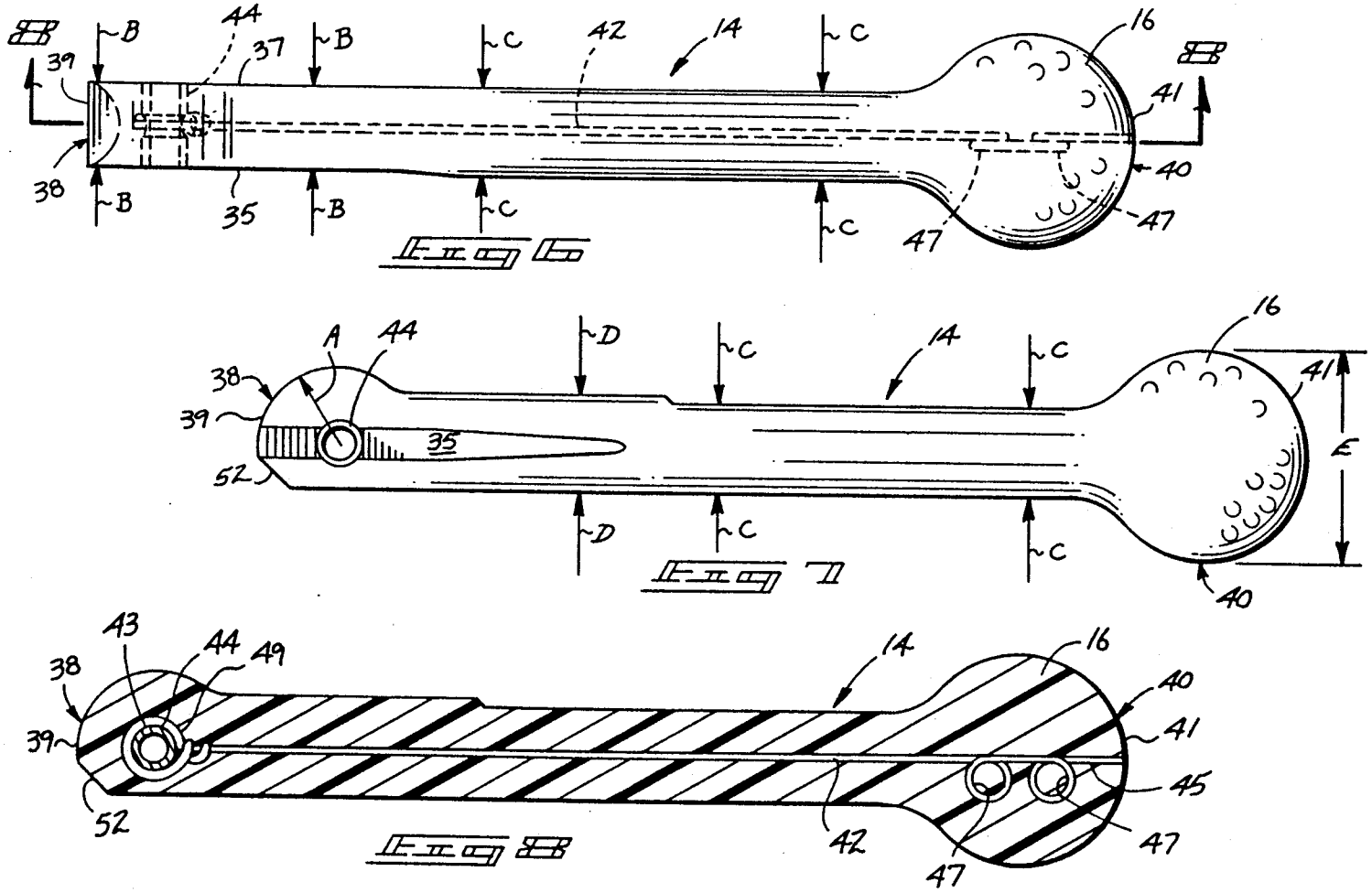
FIG. 7 is a side elevational view of FIG. 6.
FIG. 8 is a cross sectional view taken along line 8—8 in FIG. 6.
Figure 4:
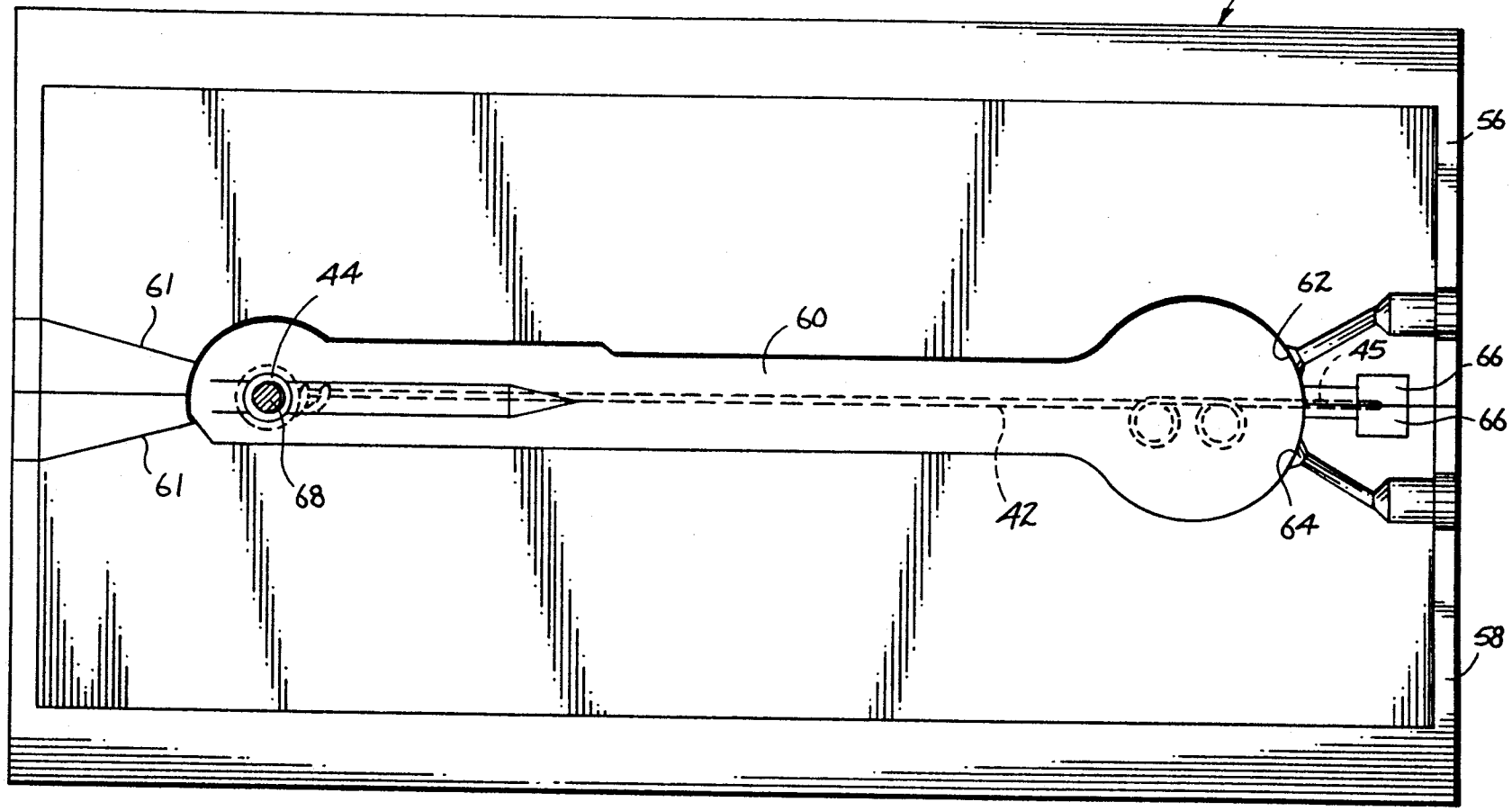

For completion of the disclosure and with reference to FIGS. 6, 7, and 9, those dimensions are as follows. The golf-ball size object end portion of cavity 60 is round and has a dimension of 1 and 11/16 inches (FIG. 7, arrow E) to correspond to the diameter of a regulation golf ball. The remaining portion of arm 14 is substantially circular in cross section. The substantial portion of arm 14 immediately adjacent golf-ball sized object 16 is 18 mm in diameter (the dimension between arrows C—C). Arm 14 then tapers or narrows to 16.90 mm in width (the dimension between arrows B—B) to accommodate fitting within channel 31 of spinner 28. This provides opposing flat side surfaces 35, 37. The height of arm 14 along the narrow tapering increases from 18 mm to 20 mm (the dimension between arrows D—D). End 38 of arm 14 is then raised and rounded about a 15 mm radius (FIG. 7, arrow A) to facilitate flow of the injection molding material, which in the illustrated embodiment is injected from the ball end of the mold through upper and lower fan-shaped injection ports 62, 64 respectively (FIG. 9). The overall length of arm 14 and correspondingly cavity 60 in the illustrated embodiment is 209.55mm. The length of the combination of the rounded portion and the 20mm high portion is 65mm. Hollow tube 44 (FIGS. 4 and 5) has an external diameter of 9mm, an internal diameter of 6mm, and a length of 17mm. Circumferential groove 50 is 3mm in width and centered between the ends of tube 44. Alternate dimensions for these various components could of course be used without departing from the principles and scope of the invention.

Rod 42 is preferably 0.105 gauge comprised of spring steel wire as described above. In the illustrated and preferred embodiment, it is first bent into the desired configuration as shown to provide the two loops 47 and the loop 49, and subsequently tempered at approximately 375° F. for approximately 20 minutes to rigidify the rod. The tempered rod is then cleaned with a solvent, such as Union Carbide Silanes TM A-1100, to remove any residue to facilitate adherence of the molding material with the rod. Rod 42 could also be roughened to further facilitate bonding between the molding material and rod. Rod 42 is also preferably initially configured to have a length which is overall greater than the length of the finished rod 42 as it is received within arm 14 of the finished apparatus. This serves to both, (a) facilitate the manufacturing process, and (b) enable the rod to ultimately extend to be flush with external arm surface 41 to maximize the reinforcing effect of rod 42 along arm 14.

In beginning the molding process, the looped end 43 of the tempered steel rod is positioned over hollow tube 44 such that tube groove 50 receives rod loop 49. Rod 42, and tube 44 engaged thereby, are then placed or inserted within mold cavity 60. The first and second rod ends 45, 43 respectively, are then secured from any movement relative to cavity 60. First rod end 45 upon placement as illustrated, extends longitudinally and externally from cavity 60. It is clamped or held in position by a pair of rod clamps 66 which are integrally formed as part of mold halves 56 and 58. These function to grasp that portion of rod end 45 which extends from cavity 60 as shown.

Second rod end 43 is secured within cavity 60 by sliding a temporary shaft 68 through hollow tube 44. Shaft 68 is then restricted from movement relative to mold 54 to secure second rod end 43 relative to cavity 60. Securing rod ends 43 and 45 from movement effectively secures rod 42 from movement during the injection process. It is especially important that first rod end 45 adjacent where the molding material is injected is restricted from movement to minimize any vibration of rod 42 during the high pressure injection. Movement of rod 42 during or immediately after injection could adversely affect the integrity of the finished arm.

After positioning as described, the Surlyn TM material is then injected into cavity 60 through fan-like openings 62 and 64 at the golf ball size end of cavity 60. Suitable vents 61 should be provided at the opposite end of cavity 60 to provide for escape of the gas that is within cavity 60 at the time the material is injected. Lack of venting could cause poor weld line strength, excessively high injection pressures, and longer than necessary fill times.

After the molding material has sufficiently hardened, the rigid support arm and shaft can be moved relative to one another to remove the shaft 68 from support tube 44. Arm 14 is ultimately removed from the mold and the externally extending first end 45 of reinforcing rod 42 is cut and smoothed flush with external surface 41 of support arm 14.

In compliance with the statute, the invention has been described in language more or less specific as to methodical and structural features. It is to be understood, however, that the invention is not limited to the specific features shown and described, since the means and construction herein disclosed comprise a preferred form of putting the invention into effect. The invention is, therefore, claimed in any of its forms or modifications within the proper scope of the appended claims appropriately interpreted in accordance with the doctrine of equivalents.

I claim:

1. A method of making a solid mass elongated rigid radial support arm for mounting relative to a base of a golf-swing practicing apparatus, the support arm having opposed longitudinal ends, one of such opposed longitudinal ends comprising an integrally formed solid mass golf-ball sized object for hitting by a golfer to cause the support arm to rotate relative to the base, the other of the longitudinal ends having a hollow tube extending tansversely across the support arm, the support arm including a central reinforcing rod extending along a substantial longitudinal length thereof, the central reinforcing rod having opposed first and second longitudinal rod ends, the second rod end engaging the hollow tube to restrict any tendency of the central reinforcing rod to move longitudinally relative to the tube, the method comprising:

providing a mold having an elongated internal cavity of a shape which corresponds to the finished external shape of the finished rigid support arm;

placing the central reinforcing rod and tube engaged thereby within the cavity, the first rod end upon placement extending externally from the cavity;

securing the first rod end from movement relative to the cavity;

sliding a shaft into the hollow tube, and securing the shaft from subsequent movement, to restrict movement of the second rod end relative to the cavity;

injecting a flowable molding material into the cavity after the first rod end has been secured from movement relative to the cavity;

allowing the injected molding material to harden;

cutting the externally extending first end of the reinforcing rod flush with an adjacent external surface of the rigid support arm; and moving the rigid support arm and shaft relative to one another after the injected molding material has sufficiently hardened to remove the shaft from the support tube.

* * * * *